United States Patent [19]

Diener et al.

[11] Patent Number: 4,778,106

[45] Date of Patent: Oct. 18, 1988

[54] STUD, ARC SHIELD AND RAIL CLIP FOR SECURING RAILROAD RAILS

[75] Inventors: Leslie J. Diener, Torrens Park; William F. Langman, Belair; George P. Dunn, Morphett Vale; Albert E. Rex, Linden Park, all of Australia

[73] Assignee: Omark Industries, Inc., Portland, Oreg.

[21] Appl. No.: 747,984

[22] Filed: Jun. 24, 1985

Related U.S. Application Data

[63] Continuation of Ser. No. 366,655, Apr. 8, 1982, abandoned, which is a continuation-in-part of Ser. No. 44,905, Jun. 4, 1979, abandoned.

[30] Foreign Application Priority Data

Jun. 2, 1978 [AU] Australia ..... PD4586

[51] Int. Cl.[4] ..... E01B 9/48

[52] U.S. Cl. ..... 238/349; 238/351

[58] Field of Search ..... 238/310, 338, 349, 351

[56] References Cited

U.S. PATENT DOCUMENTS

| | | | |
|---|---|---|---|
| 1,067,125 | 7/1913 | Maney | 238/349 |
| 2,265,745 | 12/1941 | Roscoe | 238/349 |
| 2,281,750 | 5/1942 | Clarkson | 238/349 |
| 2,324,134 | 7/1943 | Chidester | 238/349 |
| 2,535,337 | 12/1950 | Wertz | 238/349 |

FOREIGN PATENT DOCUMENTS

| | | | |
|---|---|---|---|
| 657980 | 3/1938 | Fed. Rep. of Germany | 238/349 |
| 148222 | 7/1920 | United Kingdom | 238/349 |
| 652305 | 4/1951 | United Kingdom | 238/349 |
| 968128 | 8/1964 | United Kingdom | 238/349 |
| 973771 | 10/1964 | United Kingdom | 238/351 |

*Primary Examiner*—Robert B. Reeves
*Assistant Examiner*—Scott H. Werny
*Attorney, Agent, or Firm*—Charles F. Duffield

[57] ABSTRACT

Welding methods and articles are disclosed for securing railroad rails to supporting surfaces including a retaining stud, an arc shield for use in welding the retaining stud, a rail clip for securing the rail and tools for installing and removing the clip. The retaining stud is a T-shaped stud with a rectangular stem and head, the under surface of which forms an arcuate reaction surface. The stud is welded by the arc stud welding technique in which the method of controlled time and current controls the ultimate weld height and angulation of the stud. The welding is in conjunction with an arc shield, the face of which is complementary to the surface being welded and which includes a weld fillet cavity configured to provide constant weld fillet volume. The rail clip is generally U-shaped with a straight backed heel. In a preferred embodiment, the upper and lower limbs overlie one another and are bifurcated and straddle and cooperate with the stem of the stud. The upper toes include depressions which engage the head of the stud. The outer extremities of the lower toes are reaction surfaces which engage the rail and include upward deflections which engage the arcuate depressions upon deflection to provide a spring rate change.

20 Claims, 8 Drawing Sheets

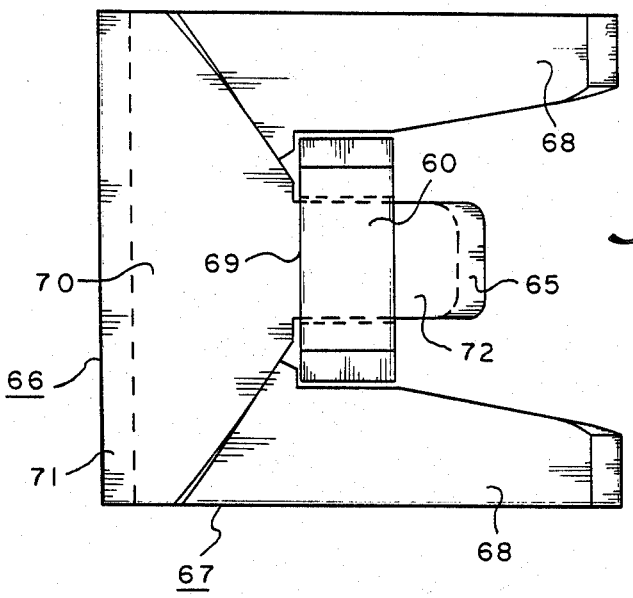
Fig. 10
Fig. 11
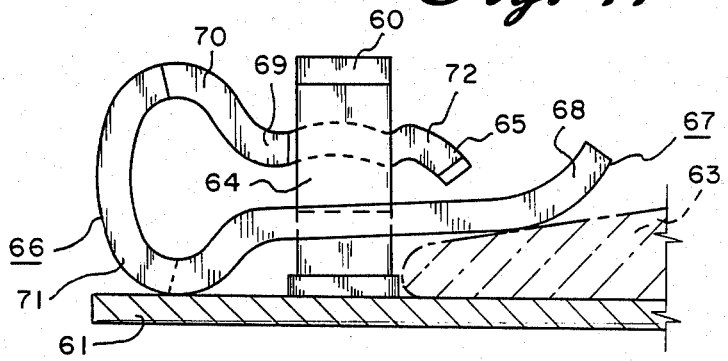
Fig. 12
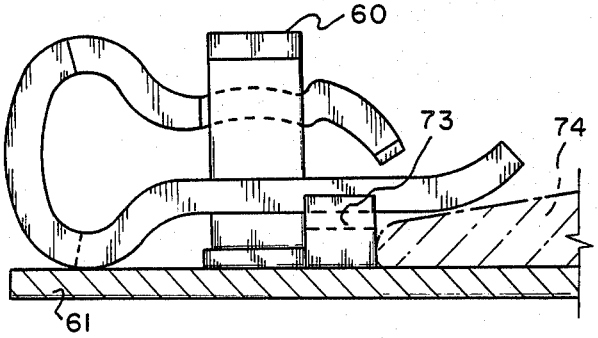
Fig. 13
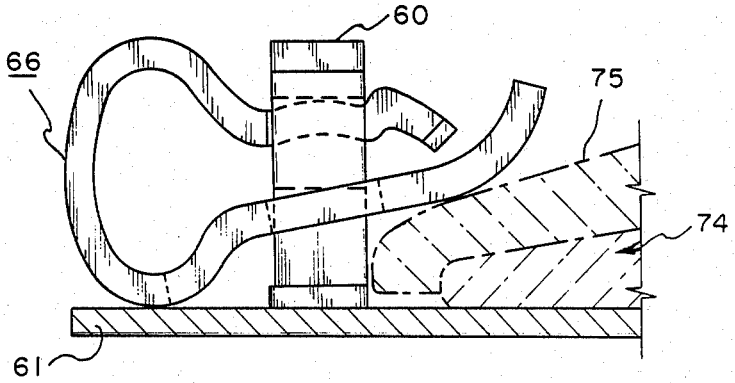

STUD, ARC SHIELD AND RAIL CLIP FOR SECURING RAILROAD RAILS

The present application is a continuation of application Ser. No. 366,655, filed Apr. 8, 1982, now abandoned which is a continuation-in-part of patent applicaiton Ser. No. 044,905, filed June 4, 1979 now abandoned.

BACKGROUND OF INVENTION

The present invention applies to studs and clips for retaining rails to a rail supporting surface.

Rail clips (cleats) and retaining members of many configurations have been heretofore proposed. Some of these combinations and configurations have been somewhat successful but all fall short of the ideal rail retaining combination.

There are many requirements of a satisfactory rail retaining combination. Low cost and simplicity of operation are of great significance. Generally, a two piece combination is preferable from the standpoint of both cost and simplicity.

Of great importance in a rail retaining combination is that the clip provide the required rail retaining pressure without overstressing of the clip which would result in ultimate fracture and failure of the clip. It is additionally desirable that the combination provide a means by which rail overturn in extreme rail loading conditions can be avoided.

Another desirable feature of a rail retaining combination is that the device provide a low profile. This is necessary to provide clearance for such equipment as ballast regulators, snow plows and certain other machinery used upon the rails.

Another requirement of a desirable rail retaining combination is that, while the clips may be inserted or put into position without sophisticated equipment, it should resist disengagement by such means as vibration or vandals. Additionally, during installation of the clip, the design should be such that overdrive and thus overstress of the clip can be avoided.

In addition to providing the necessary rail hold-down pressure, it is also a desirable feature of an ideal rail retaining combination that the clip resist rail creep, i.e. longitudinal movement of the rail.

A further desirable feature of an ideal rail retaining combination is that the combination be capable of use in original installations or to retrofit existing installations. In the latter case, it is particularly important that the combination be a part of a system of installation which can be utilized with tie plates and rails of differing manufacture and configuration while using a standardized set of components.

Many clips which have been used heretofore have been formed from resilient plate which has one end bearing against the tie and the other against the rail foot, while a pin, bolt head or the like loads the central part of the clip. With this arrangement, however, the clip size is considerable and its stress is very high for a given spring rate.

Some designs have reduced the spring rate of the clip by imparting the loading to a clip having a return configuration something after the style of a "hairpin". An example of this design is shown in U.S. Pat. No. 3,451,621 to De Splinter which discloses a generally hairpin shaped clip which bears against the foot of the rail at one end and wherein the pressure is applied by a pin against the return end. However, the height of this clip is considerable and creates an interference with equipment upon the rails. Additionally, the clip involves the use of secondary fixing means which adds to the cost and complexity of the combination.

Another design of rail clip which utilizes a two part combination is disclosed in U.S. Pat. No. 4,067,495 issued to Portec. This arrangement is a single knock-on clip but the clip extends in a direction longitudinal to the rail and consequently is subject to serious disabilities such as rail creep. Additionally, the Portec device is made of rod having a substantially constant cross-sectional shape and the strain is much greater at the center than near the end such that optimum use of material is not achieved. Further, the Portec clip can be relatively easily dislodged, for example by vandals, with consequential hazard with respect to rail displacement.

U.S. Pat. No. 3,831,842 to Tamura discloses the use of a threaded member close to the intermediate portion of a hairpin type clip. Although the clip is of the general hairpin shape, it really functions in much the same way as the so-called flat plate clips.

Other disclsures of hairpin type clips are in British patent No. 968,128 issued to Rigby and in German patent No. 657,980 issued to Lossl. The structure of the British patent has several shortcomings. Among these is that the clip operates in conjunction with a U-shaped anchor which is driven into the cross tie and which is susceptible of varying heights to create variations in rail loading. Additionally, the U-shaped spike is susceptible of being withdrawn or loosened from its holding position. Additionally, the configuration of the clip in the British patent and its cooperation with the rail spike is susceptible to rotation thus being susceptible to rail creep. Another problem with the British patent is that, during insertion, there is no guard against overdriving and overstressing of the clip. Furthermore, the spacing of the upper and lower members and their configuration will permit the rail to rise out of the recess into which the rail is positioned thus permitting rail overturn. The British clip is further unsuited for use with metal rail plates which are the more prevalent configuration.

The rail clip combination shown in German patent No. 657,980 likewise has many drawbacks. The German clip combination must be utilized in conjunction with a rail plate which has formed integral therewith the retaining member. This is an extremely expensive combination. Additionally, the spacing of the upper and lower members is such that the rail will become any lockup occurring in the clip and may thus permit rail overturn. The German clip configuration is not susceptible to retrofit to existing rails but must be with newly replaced tie plates. Further, the heel configuration of the rail clip in the German patent is of a type that does not provide for ultimate control of the bending moment in the clip to achieve optimum rail engaging pressure.

SUMMARY OF INVENTION

The rail clip combination of the present invention utilizes, in a preferred embodiment, a T-shaped stud which is welded to the rail plate in conjunction with a special arc shield. The retaining clip is a U-shaped clip which includes a heel portion and upper and lower limbs of which are bifurcated into toes which, when driven into place, engage the head of the T-stud.

The T-stud is an end weldable stud with a rectangular stem portion. The head of the stud is generally rectangular in the direction longitudinal of the rail. The underneath surface of the head of the stud is an arcuate reaction surface for engaging the U-shaped clip.

The T-stud is welded to a rail plate by the arc stud welding technique. The duration of welding current and magnitude of welding current are adjusted to provide the appropriate burnoff of the stud, as required, for each given configuration. Additionally, the angulation of the stud relative to the rail plate may be adjusted to the prescribed conditions for optimum placement of the stud relative to the rail foot. The combination of the burnoff and the angulation of the stud permits use of a standard stud and rail clip with rails and rail plates of differing configurations.

A special arc shield, according to the present invention, is utilized in conjunction with the rectangular stemmed stud. The arc shield includes a face that is of configuration complementary to the surface upon which the stud is to be welded. Additionally, the weld fillet cavity of the stud is of a configuration such that a constant volume weld fillet cavity is maintained irrespective of the configuration to provide a uniform weld fillet.

In one embodiment, the retaining clip is a U-shaped retaining clip which has a straight heel portion which extends into an upper and lower limb portion. The upper and lower limbs overlie one another and include a slot in each to bifurcate the upper and lower limbs into two toes each respectively.

The upper toes include an arcuate depression which is designed to be complementary to and engage the arcuate reaction surface of the stud head when the clip is in place. The depth of the slot forming the bifurcated upper toes is of a depth such that it engages the head of the stud when in place to prevent overdrive and overstress.

The lower toes of the lower limb terminate in rail engaging surfaces and are designed to engage the rail to apply the downward pressure upon the rail when the clip is in place. Positioned directly beneath the arcuate depression of the upper toes are upward deflections in the lower toes. The upward deflections, when the clip is in place, are in vertical alignment with the reaction surface of the stud head and spaced therefrom a distance such that, upon attempted rail overturn and disengagement from the rail recess in the rail plate, the upward deflections will engage the arcuate depressions and provide a spring rate change and lockup to prevent rail overturn.

The spacing between the side walls of the upper and lower toes is such that there is a minimal clearance between these side walls and the rectangular stem of the stud to provide a lock against transverse or rotational movement of the clip upon the presence of any transverse or rotational force on the clip to assist in controlling rail creep.

In a second embodiment, the clip is generally U-shaped having a heel, a lower limb which is bifurcated into two toes and an upper limb which is a projecting tongue. A retaining stud is utilized as an upper and lower edge wall and two side walls with an aperture therethrough into which the tongue is positioned in stressed engagement with the upper wall. The lower toes are positioned on the outside of the side walls to constrain the clip against rotation.

In a third embodiment, a generally U-shaped clip having a heel portion and upper and lower limbs is utilized in conjunction with an inverted U-shaped anchor. The anchor may be suitably cast in a concrete tie. The upper lib includes a depression surface which reacts in engagement with the undersurface of the inverted U-shaped anchor.

Tools are further disclosed for utilization in the insertion and removal of the clips.

DESCRIPTION OF DRAWINGS

FIG. 10 is a plan view of a clip according to a second embodiment;

FIG. 11 is an end elevational view of the clip of FIG. 10 when in place;

FIG. 12 is an elevational view of the clip of the embodiment in FIG. 10 shown in combination with a spacer when a smaller rail is used;

FIG. 13 is an elevational view of the clip of the embodiment of FIG. 10 shown in combination with a fish plate;

DETAILED DESCRIPTION OF DRAWINGS

Figure 1:
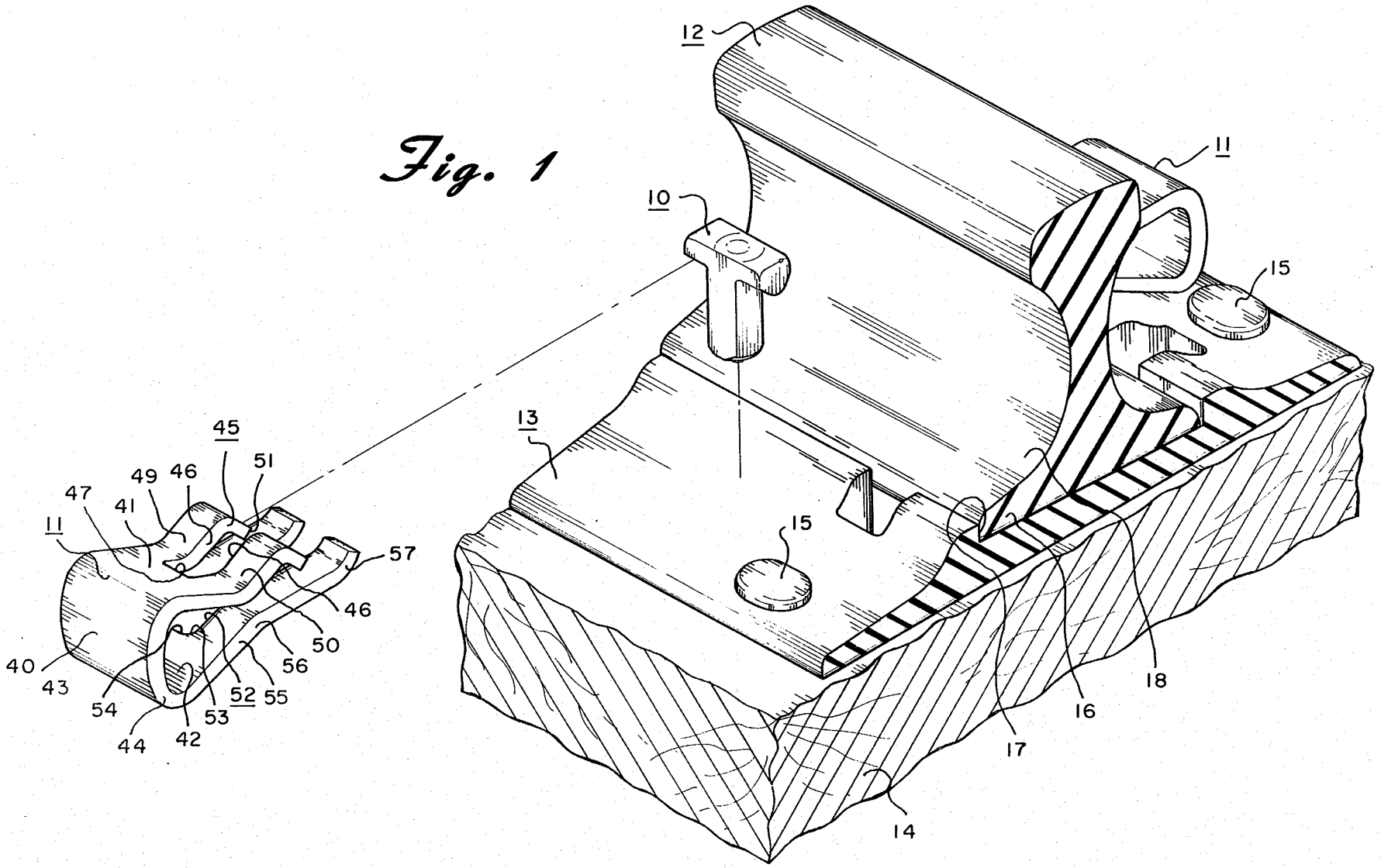
FIG. 1 is a perspective exploded view of a first embodiment of the rail retaining clip of the present invention.

The first embodiment of rail fastener combination in accordance with the present invention is shown in FIGS. 1–9 of the drawings. In overall, as shown in FIG. 1, the first embodiment of rail fastener combination includes a T-shaped retaining stud 10 and a generally U-shaped rail clip 11. The combination is designed to retain a rail 12 to a rail retaining plate 13 which is secured to a cross tie 14 by conventional spikes 15. The rail retaining plate 13 includes a rail retaining recess 16 defined by opposed shoulders 17 for retaining the foot 18 of the rail in place.

Figure 3:
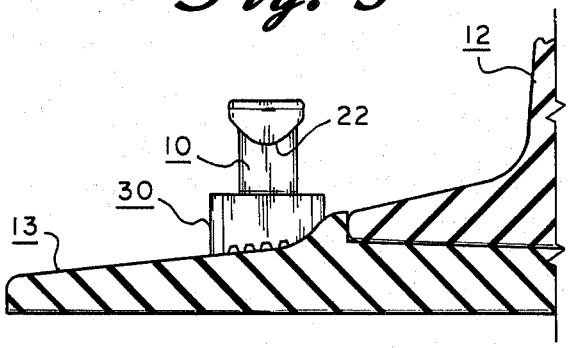
FIG. 3 is an elevational view of the stud of the embodiment of FIG. 1 in place prior to welding in combination with the arc shield of FIG. 2.
Figure 4:
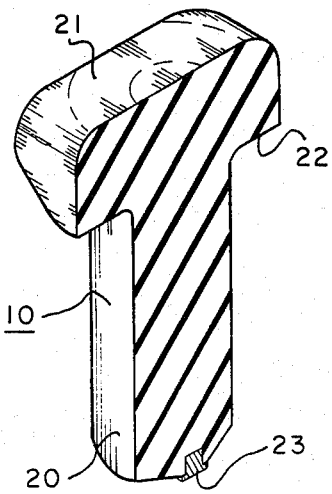
FIG. 4 is a perspective sectional view of the stud utilized in the embodiment of FIG. 1.

The rail retaining stud 10 is best seen in FIGS. 3 and 4 of the drawings. The retaining stud 10 includes a rectangular stem 20. Surmounting the stem 20 is a T-shaped integral head 21. The head of the stud is generally and the long axis of the head of the stud is intended, when welded in place, to extend longitudinally of the rail.

The underneath and overhanging extremities of the head 21 of the stud provide a reaction surface against which the clip, as to be described hereinafter, will react to provide the stress in the rail fastener combination. The reaction surface 22 is curved or arcuate and, as will be described more fully hereinafter, is designed to cooperate with a similar configuration in the upper toes of the rail clip.

The retaining stud 10 is of a weldable grade material capable of being welded by the arc stud welding technique. As required, suitable fluxing material 23 may be included in the weldable end of the stud to enhance the welding characteristics of the stud to the rail retaining plate.

The retaining stud 10, in the embodiment of FIG. 1 is preferably welded slightly up the slope of the shoulder 17 of the rail retaining plate 13. It has been found by experience that the positioning of the retaining stud 10 at this location consistently for all different variations of rail retaining plates provides the optimum location for positioning of the retaining clip relative to the rail foot for differing configurations of retaining plates and rails as will be described further hereinafter.

Welding of the retaining stud 10 on the shoulder 17 of the rail retaining plate presents a condition where the stud is being welded, in most cases, to the surface of the rail retaining plate at less than a right angle. Under these circumstances, the portion of the stud engaging the higher level of the sloping shoulder will be the first portion of the stud to be melted with consequent solidification in the molten pool during the arc stud welding technique. Inasmuch as there will be a greater quantity of material melted on the upper side of the slope than on the lower, special problems are encountered concerning the manner and technique by which this excess molten material is handled.

Figure 2:
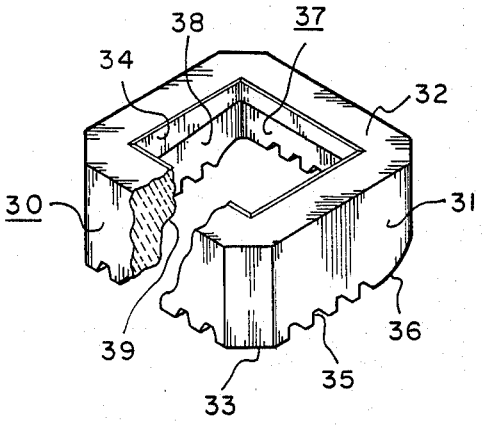
FIG. 2 is a perspective view of the arc shield according to the present invention utilized for welding the stud of the embodiment of FIG. 1.

In accordance with the present invention, a special arc shield 30 is provided as shown in FIG. 2. In a preferred embodiment, embodiment, the stem 20 of the stud 10 is square. As may be seen in FIG. 2, the arc shield 30 is formed with four side walls 31, a top wall 32 and a lower or face wall 33. The upper portion of the arc shield includes a rectangular stud top bore 34 which is of configuration complementary with the square stem 20 of the stud and just slightly larger in order to permit the stud stem to pass into the stud arc shield top bore 34 as shown in FIG. 3 of the drawings.

The lower face 33 of the arc shield includes a plurality of vent grooves 35 around all four sides of the arc shield. The arc shield face 33 is formed complementary to the configuration of the rail retaining plate to which the stud is to be welded. In the embodiment shown in FIG. 2, the face includes an inclined portion 36 which, as may be seen in FIG. 3, permits the arc shield to conform to the angle and configuration of the rail retaining plate 13 in the area of the shoulder 17 at which point the stud is to be welded.

The arc shield, as shown in FIG. 2, includes a weld fillet cavity 37 which is defined by four side walls 38 and an upper wall 39 at the lower terminus of the stud top bore 34.

The upper wall 39 of the weld fillet cavity 37, as may be seen in FIG. 2, is sloped upwardly in the direction of the inclined portion 36. In this manner, the volume of the weld fillet cavity in the area of the inclined portion 36 is equal to or slightly greater than that portion of the weld fillet cavity opposite from the inclined portion. In this manner, during welding of the stud, the excess molten metal in the area adjacent the inclined portion of the shoulder 17 will be accommodated and a uniform weld fillet will be formed around the base of the stud following full welding thereof. Following welding, the arc shield which is made of a ceramic material and which is very brittle, is struck with a hard object and is shattered and removed from around the base of the stud.

The details of the rail retaining clip 11 are shown in FIGS. 1 and 5–9 but more particularly in FIG. 1. The clip 11 includes a straight backed heel portion 40 which extends into an upper limb 41 and a lower limb 42. The upper and lower limbs 41 and 42 respectively join the heel portion 40 at an upper radius 43 and lower radius 44 of relatively small radius compared to the height of the heel. In this manner, the bending moment of a lower limb into the heel portion of the rail clip is greater in the arcuate portions 43 and 44 providing increased rail engaging pressures.

The upper limb 41 includes an upper slot 45 having opposed side walls 46 and an end wall 47.

The upper limb slot 45 bifurcates the upper limb into two toes 49. Both toes 49 include arcuate depressions 50, the radius of which approximates the radius of the arcuate portion 22 of the head of the stud 20. The arcuate depressions cooperate with the arcuate reaction surface 22 of the stud as will be described hereinafter. Lastly, the upper toes 49 of the clip terminate in downturned camming surfaces 51 which aid in insertion of the clip under the head of the stud as will be described hereinafter.

The lower limb 42 of the rail clip includes a similar lower slot 52 which has opposed side walls 53 and end wall 54. The lower slot 52 bifurcates the lower limb into two toes 55.

Each of the toes 55 positioned directly beneath the arcuate depressions 50 of the upper toes include upward deflections 56 which, as will be explained in more detail hereinafter, engage the under surface of the arcuate depressions 50 to provide spring rate change and lockup to prevent rail overturn. The outer extremities of the lower toes 55 terminate in rail engaging surfaces 57 which engage the foot of the rail to provide the bearing pressure upon the rail. The rail engaging surfaces 57 are upturned to provide a camming action to aid in insertion of the clip, as will be described hereinafter.

Figure 7:
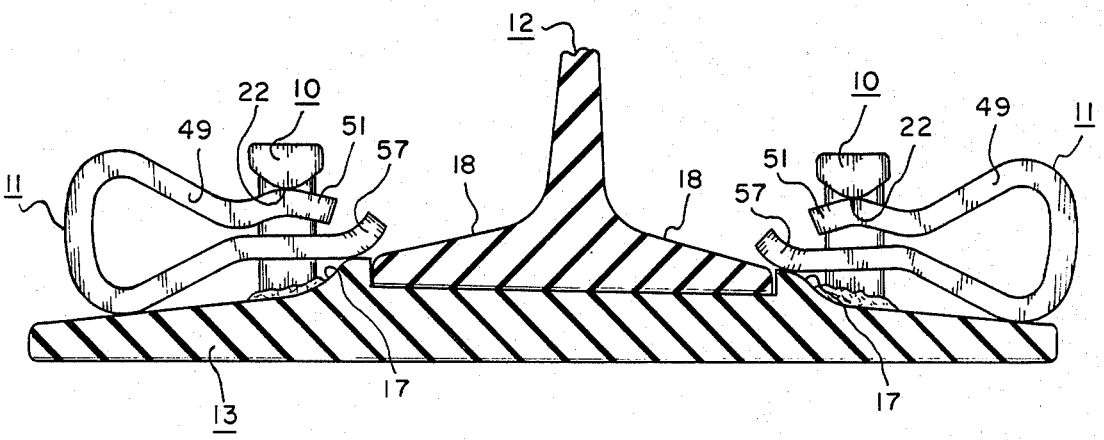
FIG. 7 is an elevational view of the stud and clip of the embodiment of FIG. 1 prior to placement of the clip.

The cooperation of the clip with the stud during placement of the stud is shown in FIG. 7. The clip may be driven into place by means of a spike hammer or by means of a special insertion tool as disclosed and discussed more fully hereinafter. During insertion of the clip under the head of a stud, upturned cam surfaces of the rail engaging surfaces 57 will ride upwardly over the shoulder 17 of the rail retaining plate 13. Concurrently, the camming surfaces 51 on the upper toes 49 will cam under the arcuate reaction surface 22 of the stud 10. As the stud is driven toward the foot 18 of the rail, the clip will be compressed permitting the clip to move into stressed and locking engagement with the stud 10.

Figure 8:
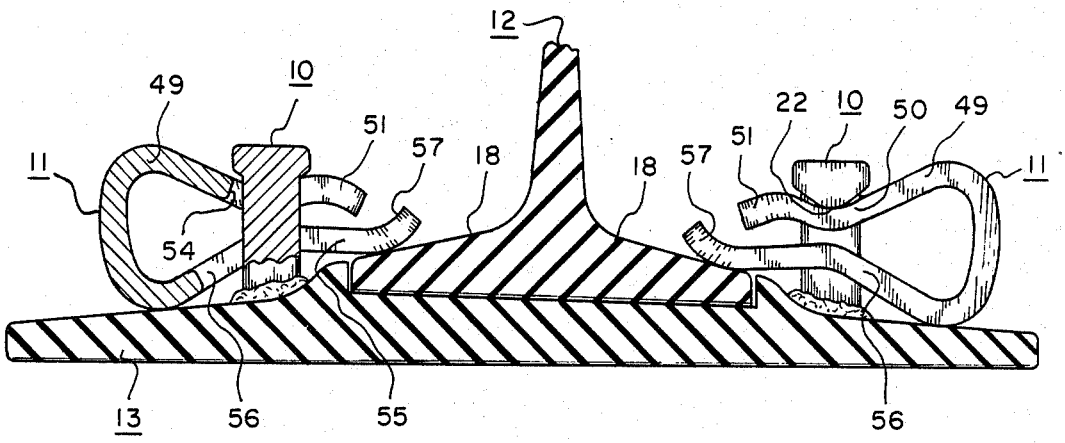
FIG. 8 is an elevational view partially in section of the stud and clip of the embodiment of FIG. 1 when in place.

The clip, when in place upon the stud, is shown in FIG. 8. When in place, the arcuate depressions 50 cooperate with and mate with the arcuate reaction surface 22 of the stud 10. In this manner, the clip is locked in place upon the stud against rearward and disengaging movement. Further, the matin arcuate configurations of the toes of the clip and the reaction surface of the stud provide resistance to rotational movement of the clip which will make the clip rigid and resist rail creep.

As may be seen in FIG. 8, the spacing of the end wall 54 of the upper limb slot is of a depth such that the end wall is in engagement or slightly spaced backwardly from the outside edge of the side wall or stem of the stud. Further, the end wall is of configuration complementary to the stud stem. In this manner, any attempt to force the clip further inwardly beyond the proper positioning of the reaction surfaces of the stud with the arcuate depressions of the upper toes is prevented by the end wall 54 engaging the side wall stem of the stud. In this manner, overdriving of the clip relative to the stud and overstressing of the clip is prevented. As further may be seen in FIG. 8, once the clip is in place, the reaction surfaces 57 of the cup bear downwardly upon the outer edge of the rail foot 18 and provide the required rail retaining pressure.

The stud and clip combination of the present invention is adapted for use on new manufactured rail retaining plates or as a retrofit to existing rail tracks. In the former case, the studs may be welded to the rail retaining plates at a remote location or on track during building of the track. In the latter case, the studs may be welded by hand or by automatic machinery to the rail plates in existence and already in place in track. The rail fastening combination may be used on tangent track and has especially good properties for curves wherein stresses are greatest.

Two of the more important and critical factors in the rail fastener combination of the present invention are the point at which the rail engaging surfaces 57 engage the foot of the rail, i.e. positioned from the edge thereof and also the pressure or compression upon the rail clip which controls the amount of varying pressure of the rail engaging surfaces upon the rail foot. Control of these two parameters becomes extremely important and depends upon a number of factors. Rail plates differ from manufacturer to manufacturer and railroad to railroad. In some rail plates the angle of the slope of the rail plate from the outer edge thereof inwardly toward the flange differs between the outside track and inside of the track. This is due to, among other things, the degree of inclination of the rail retaining recess or seat to provide rail inclination. Additionally, the thicknesses of the foot of rails differ depending upon rail size. Further, depending upon the manufacturer of the rail retaining plate, the relative dimensions of the foot of the rail relative to the outer surface of the rail retaining plate will vary between different rail plate and rail combinations.

In accordance with the apparatus and methods of the present invention, these variables can be compensated for, utilizing a standard rail clip and stud of prescribed length, while still maintaining optimum positioning of the rail engaging surfaces relative to the rail edge and optimum rail engaging pressure.

Figure 5:
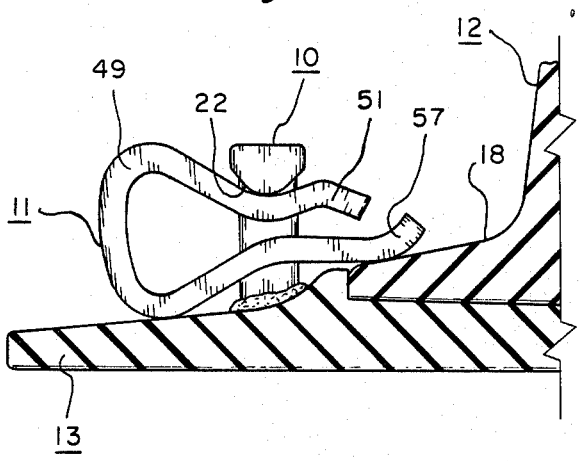
FIG. 5 is an elevational view of the clip and stud of the embodiment of FIG. 1 inserted in place showing relative position of the clip to the rail foot.
Figure 6:
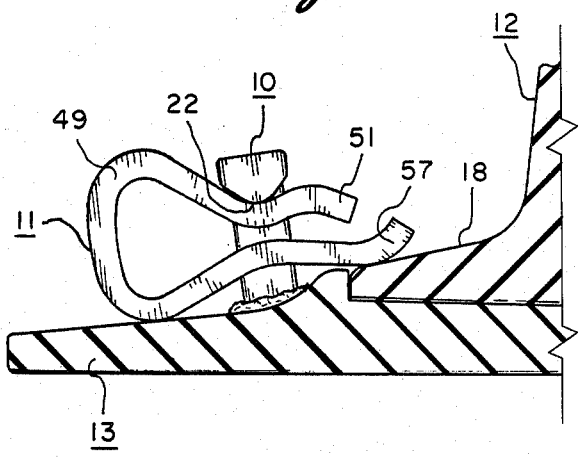
FIG. 6 is an elevational view of the stud and cup of the embodiment of FIG. 1 showing a different relative positioning of the clip relative to the rail foot with differing stud angulation.

Referring now to FIGS. 5 and 6, there are illustrated two different rail plates-rail combinations and the manner in which optimum rail engaging pressure and rail engaging surface positioning is achieved.

In accordance with the present invention, the relative angulation of the stud relative to the surface of the rail retaining plate upon which it is welded, will control the positioning of the rail engaging surfaces relative to the rail foot. For example, in FIG. 5 the stud is welded in a vertical plane. In this case, the reaction surface of the stud is further forward toward the rail foot than as the situation shown in FIG. 6 in which the stud is welded at an angle inclined away from the vertical and away from the rail. Inasmuch as the arcuate depressions of the rail clip mate with the arcuate reaction surface of the stud, inclination of the stud toward or away from the rail will change the relative position of the rail engaging surfaces 57 relative to the rail foot 18. This angulation for any given rail retaining plate and rail may be calculated for any number of combinations.

The amount of compression of the clip essentially controls the amount of rail engaging force placed upon the foot of the rail. The amount of compression of the clip is likewise essentially controlled by the distance between the reaction surface of the stud and the combined juxtaposition of the rail retaining plate and rail foot relative thereto. For any given combination of rail retaining plate and rail, this optimum height can be determined. Once this is determined, the amount of welding time and welding current applied to this stud during installation can be calculated to adjust the amount of stud melting or burnoff as is necessary to achieve the optimum length of the stud and thus accomplish optimum rail engaging pressure.

An important aspect of a rail retaining combination is that of controlling upset or turnover of the rail from the rail retaining recess of the rail retaining plate. The rail fastener combination of the present invention provides a lockup to prevent rail overturn as may be seen in FIG. 9 of the drawings.

Figure 9:
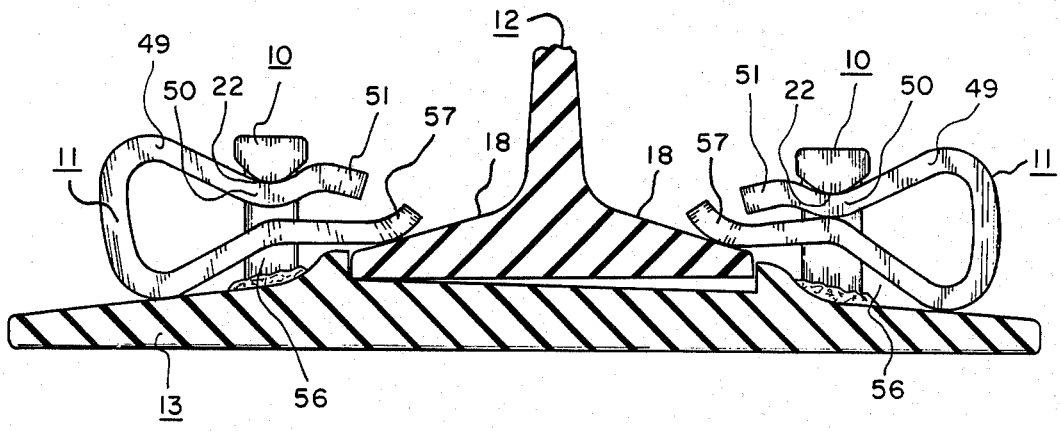
FIG. 9 is an elevational view of the stud and clip of the embodiment of FIG. 1 illustrating lockup preventing rail overturn.

The upward deflections 56 of the lower toes are aligned vertically under th arcuate depressions 50 of the upper toes which, in turn, are in vertical alignment with the center line of the arcuate reaction surfaces 22 of the stud 10. The amount of deflection in the upward deflections 56 and thus the spacing between the upper deflections and the lower surface of the arcuate depressions of the upper toes is such that, upon attempted rail upset, as shown in FIG. 9, the upward deflections will engage the undersurface of the arcuate depressions directly underneath the center line of the arcuate reaction surface of the head of the stud 10 before the rail foot clears the depth of the rail retaining recess. As this occurs, the engagement of the upward deflections with the arcuate depressions create an immediate spring rate change to a higher spring rate and effectively creates a lockup against any further deflection or movement of the rail relative to the rail plate.

The spacing between the side walls of the upper toes and of the lower toes is set slightly larger than the width of the stem of the stud. In this manner, when the stud is in place, any force tending to move the stud transversely or rotationally will result in the side walls of the upper toes and lower toes engaging the side walls of the stud providing an additional lock against rotation of the clip. Resistance to rotation of the clip tends to aid in preventing rail creep which, due to the bearing pressure of the rail engaging surfaces upon the rail, will tend to rotate the stud which resists such rotation.

From the foregoing, it will be appreciated that the first embodiment of rail clip and retaining stud provides a low cost two piece assembly which may be utilized with new rail plates or utilized to retrofit existing installations. The assembly provides a low profile assembly which resists disengagement by vibration and from vandals and also resists overdrive and overstress during installation. The rail clip and stud assembly of the first embodiment of the invention is capable of utilization on many different combinations of rail and rail plate assemblies and can control through the combination of the methods employed in welding the stud and design of the clip and arc shield to work with different existing combinations of rail plate and rail assembly to provide optimum positioning of the clip in respect to the rail and rail engaging pressure. Further, the rail clip and stud of the first embodiment provides means to control rail creep and the combination has overcome the problem of rail fastening assemblies heretofore known.

Reference is now made to the second embodiment, illustrated in FIGS. 10–13 of the drawings.

In this embodiment a stud 60 is welded to and is upstanding from a steel tie 61. The stud 60 is contiguous with a rail foot 63, and contains an aperture 64 which receives a tongue 65, the tongue 65 being a projecting portion of an upper limb of a clip 66. The lower limb 67 is bifurcate, having two toes 68 which bear down on the rail foot 63 upon deflection of the clip. As in the first embodiment, a cam surface 72 of the tongue 65 merges into a depression surface 69 which in turn merges into an upwardly and outwardly sloping surface 70, so that any inward or outward movement of the clip 66 is inhibited by its own resilience. The curved heel 71 functions as in the first embodiment. The two toes 68 straddle the stud 60, and bear against its side walls upon rail creep, or any other force which tends to rotate the clip 66. The stud 60 being contiguous with the rail foot 63, holds the rail to gauge.

FIG. 12 corresponds to FIG. 11, and illustrates the use of a spacer 73 to hold a smaller rail 74 to gauge.

FIG. 13 corresponds to FIG. 12 and illustrates the manner in which the stud 60 holds a smaller rail 74 to gauge, when use is made of a fish plate 75.

Figure 14:
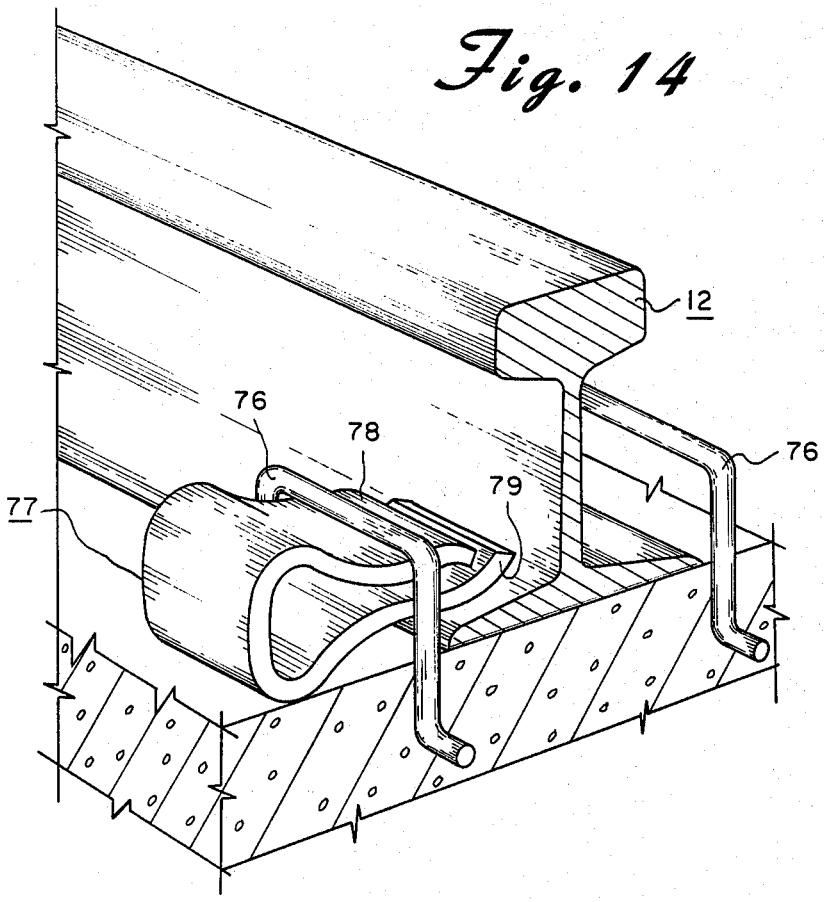
FIG. 14 is a perspective view of a third embodiment of rail clip and fastener used in conjunction with a concrete tie.

The fastener of a third embodiment shown in FIG. 14 is suitable for use on a concrete tie having an inverted U-shaped lug 76 upstanding from its upper surface. The clip 77 has an end elevational shape similar to the clip 11 in FIG. 1, but its upper limb 78 and lower limb 79, although of less crosssectional area than the intermediate portion, are not bifurcate. The under surface of the bridge portion of lug 76 is the downwardly facing reaction surface against which the depression surface of the upper limb of clip 77 bears.

While the invention makes possible easy insertion of clips, it also provides an assembly wherein removal of clips is difficult to achieve, other than with the use of a special tool, this being a valuable feature to avoid removal by vandals. The tool illustrated in FIG. 15 is an assembly tool which is useful for pushing on the clips 11 of FIG. 1.

The tool comprises a handle 80, a base 81 and a hook 82. The front of the base 81 has a pair of abutment pads 83 thereon, and the back carries on it a spring 84. A pivot pin 85 hinges the hook 82 to the base 81. The inner end or "heel" of the hook has two flat surfaces 86 and 87 thereon, selectively engageable against a face of the spring 84.

When it is desired to use the tool to position a clip 11 in place, the hook 82 is lowered over a stud 10 and the handle 80 swung to cause the abutment pads 83 to drive the clip 11 into place.

Figure 15:
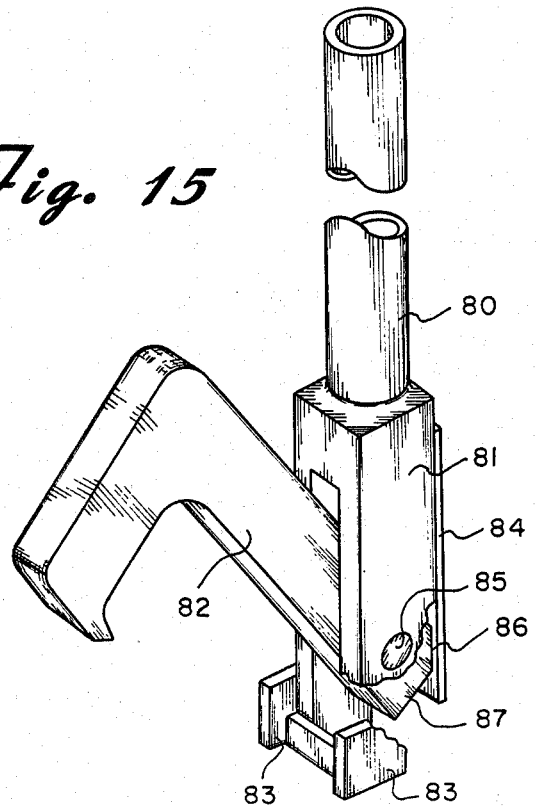
FIG. 15 is a fragmentary perspective view of a clip inserting tool useful for quick insertion of the first embodiment of clip.
Figure 16:
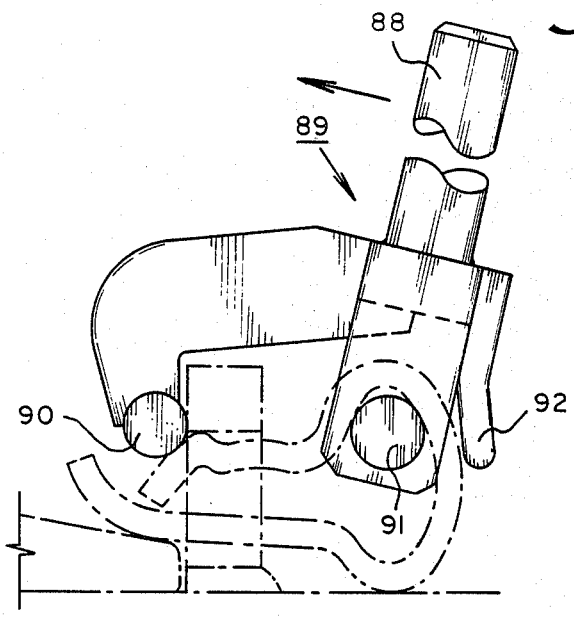
FIG. 16 is a side elevational view of a clip removing tool illustrating the first stage of removal of the second embodiment of clip.
Figure 17:
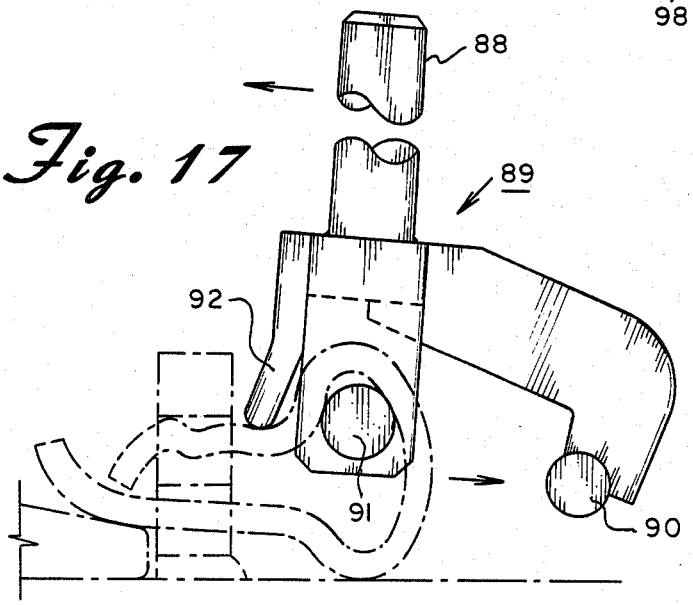
FIG. 17 is a side elevational view of the clip removal tool of FIG. 16 illustrating the second state of removal of the clip.

In many instances the tool of FIG. 15 is unsuitable for removal of clips, and use is then made of the removal tool illustrated in elevation in FIGS. 16 and 17. That tool has a handle 88 with a base 89 thereon. The base 89 has two spaced pins 90 and 91 thereon, and an abutment bar 92 at one end. The tool of FIGS. 16 and 17 is useful for removal of all the clips illustrated in FIGS. 11, 12, 13 and 14 of this specification. As shown in FIG. 16, a first stage of removal comprises depressing the upper limb of the clip and moving it a small amount. If the tool is then reversed, the clip can be levered away from its stud, as illustrated in FIG. 17.

With the tool of FIGS. 16 and 17, the fastener cli is restrained from rapid movement through the air upon release. Without this feature, a serious accident hazard exists.

Figure 18:
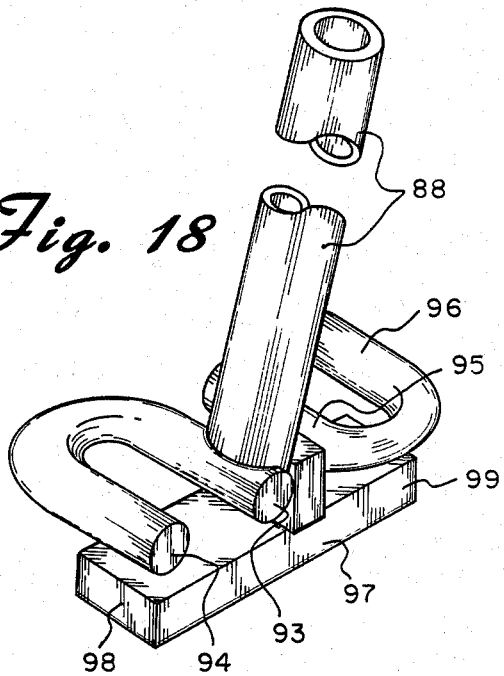
FIG. 18 is a perspective view of a modified form of clip removal tool of FIG. 16.

The tool of FIG. 18 embodies two sets of pins, the pins of the first set being designated 93 and 94, and of the second set 95 and 96. Each set of pins is comprised in a single bar formed to a U-shape. However, the base 97 is asymmetrical with respect to the sets of pins, so that end 98 or end 99 can selectively be made to bear against an edge of a rail base plate. The tool is thereby useful for removing clips on the types shown in FIG. 1 from base plates of varying widths.

Figure 19:
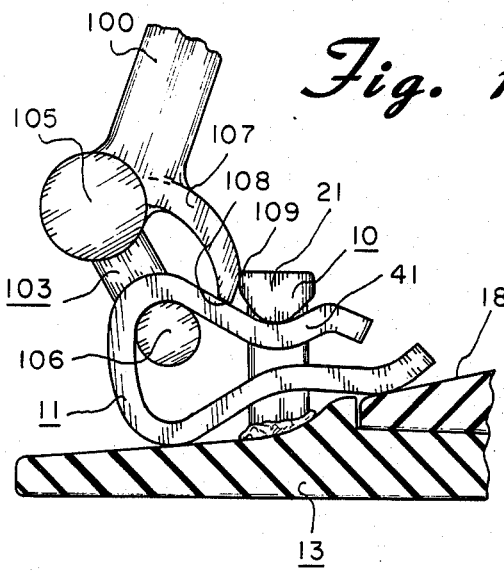
FIG. 19 is an elevational view of a modified clip removal tool before removal of the clip.
Figure 21:
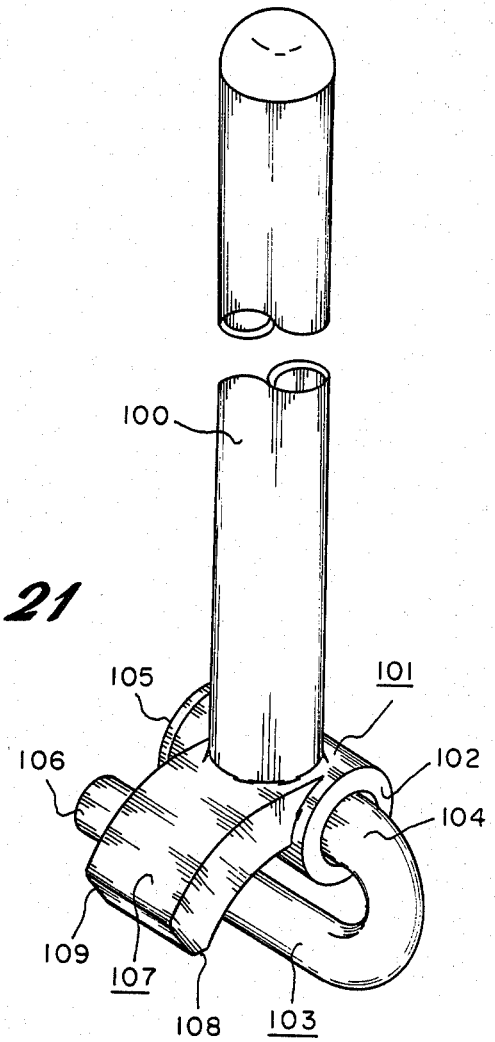
FIG. 21 is a perspective view of the removal tool of FIG. 19.
Figure 20:
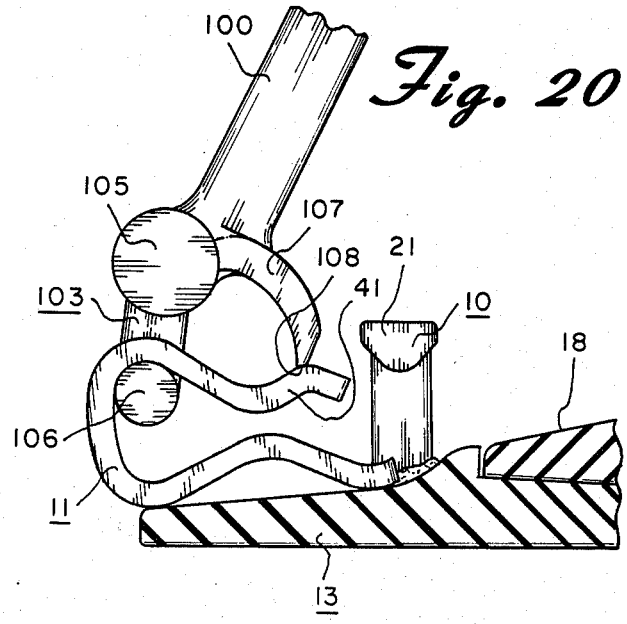
FIG. 20 is a side elevational view of the tool of FIG. 19 following removal of the clip.

A further embodiment of clip removal tool in accordance with the present invention is shown in FIGS. 19–21 of the drawings. The tool includes a handle 100 which terminates in a base member 101. The base member 101 is essentially a hollow bushing 102.

A U-shaped pulling pin 103 is provided. A first leg of the pulling pin 104 is of diameter slightly less than the inside diameter of the bushing 102 and passes through the bushing 102. A retaining washer 105 is welded to the end the first leg 104 to secure the pulling pin within the bushing and provide a pivoting action to the pulling pin. In this manner the second and free leg 106 of the pulling pin may pivot around the base member 101.

The removal tool further includes an arcuate tongue 107 projecting from the base member 101. The tongue 107 includes a pivot face 109 and a compression face 108 whose function will be described immediately hereinafter.

The removal tool in use may be seen in FIG. 19. The second and free leg 106 of the pulling pin 103 is inserted into the heel portion of the U-shaped clip 11. The tongue 107 is directed toward the head of the stud 10. In this position, the compression face 108 of the tongue 107 bears downwardly against the upper limb 41 of the clip. Additionally, the pivot face 109 of the tongue 107 bears against the head of the stud 10.

The operator, to effect removal of the clip, exerts leverage upon the handle 100 inwardly toward the rail. As this occurs, the tongue 107 will bear downwardly, by means of the compression face 108, upon the upper limb 41 to compress the upper limb and remove the inner acting force between the upper limb 41 and the head of the stud 10. Concurrently, the pivot face 109 will bear against the head 21 of the stud 10 pivoting the base member 101 around that pivot point.

By reason of the pivoting action, the base member 101, acting through the pulling pin 103, will exert a force against the clip away from the head of the stud. The pivoting action of the pulling pin 103 will compensate for the change in angulation of the base member 101 as the tool is pivoted upon the pivot face 109 of the tongue 107. As the handle 100 is levered further toward the rail, the continued force will concurrently depress the upper limb 41 while pulling the clip away from the stud 10 until finally disengagement of the clip from the stud occurs as shown in FIG. 20.

The present inventions and the embodiments thereof have been shown in respect to those particular embodiments set forth in the drawings and as described in the specification. Other variations and modifications to the inventions of the present invention will become apparent to those skilled in the art by reason of the foregoing disclosure. However, the scope of the invention is not to be limited in respect to the particular embodiments shown in the drawings and as described in the specification but the scope of the inventions are to be interpreted in view of the appended claims.

What is claimed is:

1. A rail fastener combination for fastening a rail to a rail support comprising:

a retaining stud having a stem portion secured at one end to the rail support adjacent the rail foot edge and an integral stud head formed upon the other end, the under surface of which forms a reaction surface, a generally U-sahped rail clip having a heel portion and upper and lower limb portions extending from the heel portion, the upper limb portion overlying the lower limb portion;

a lower limb slot formed in the lower limb bifurcating the lower limb into a pair of lower toes having opposed side walls, the extremities of the toes being rail engaging surfaces which engage the rail foot when the clip is in place;

an upper limb slot formed in the upper limb bifurcating the upper limb into a pair of upper toes having opposed side walls and the upper toes having stud head engaging surfaes which engage the reaction surface of the stud heada when the clip is in place such that, upon installation of the clip upon the stud, stress will be created in the clip providing rail retaining pressure by the rail engaging surfaces upon the rail foot;

a rail retaining recess in the rail support of a prescribed depth into which the rail foot is positioned for lateral restraint; and the upper and lower pairs of toes of the rail clip being so configured and spaced relative to one another that, upon rail upset and cosequent deflection of the lower pair of toes toward the upper pair of toes, the upper surface of the lower toes will engage the under surface of the upper toes before the rail foot exceeds the prescribed depth of the rail retaining recess thereby creating a spring rate change and lockup.

2. The rail fastener of claim 1 wherein the lower limb slot has a length whereby a rear wall thereof is substantialy back of the stud stem opposite the rail edge and wherein the point of engagement of the upper and lower toes is substantially along the center line of the stud head.

3. The rail fastener of claim 2 wherein the heel of the rail clip is substantially flat and joins the lower limb through an arcuate portion of relatively small radius compared to the height of the heel such that the bending moment of the lower limb into the rail clip will be greater in the arcuate portion providing increased rail engaging pressure.

4. The rail fastener of claim 3 wherein the stud stem is noncircular and the spacing between the opposed side walls of at least one of the pairs of toes is such that the side walls engage the stem upon the presence of any transverse or rotational force to prevent transverse and rotational movement of the rail clip relative to the stud.

5. The rail fastener of claim 4 wherein the upper limb slot includes a rear wall and the slot is of a length whereby the rear wall is contiguous to the stud stem when the stud head engaging surfaces of the upper toes are in position with the reaction surface of the stud to prevent overdrive and overstressing of the rail clip.

6. The rail fastener of claim 5 wherein the rear wall of the upper limb slot is of a configuration complementary to the stud stem configuration.

7. The rail fastener of claim 3 wherein the upper limb slot includes a rear wall and the slot is of a length whereby the rear wall is contiguous to the stud stem when the stud head engaging surfaces of the upper toes are in position with the reaction surface of the stud to prevent overdrive and overstressing of the rail clip.

8. The rail fastener of claim 7 wherein the rear wall of the upper limb slot is of a configuration complementary to the stud stem configuration.

9. A rail fastener combination for fastening a rail to a rail support comprising:

a T-shaped stud having a stem portion secured at one end to the rail support adjacent the rail foot edge and an integeral stud head elongated in a direction parallel to the rail axis formed upon the other end, the under surface of which is arcuate and forms a reaction surface;

a generally U-shaped rail clip having a heel portion and upper and lower limb portions extending from the heel portion, the upper limb portion overlying the lower limb portion;

a lower limb slot formed in the lower limb bifuractaing the lower libm into a pair of lower toes having opposed side walls, the extremities of the toes being rail engaging surfaces which engage the rail foot when the clip is in palce;

an upper limb slot formed in the upper limb bifurcating the upper limb into a pair of upper toes having opposed side walls and the upper toes having stud head engaging surfaces formed by arcutate depressions which engage the reaction surface of the stud head when the clip is in place such that, uppon installation of the clip upon the stud, stress will be created in the clip providing rail retaining pressure by the rail engaging surfaces upon the rail foot and the arcuate depressions mating with the reaction surface will provide an interlock between the stud and rail clip against transverse and rotational movement and accommodate different angulation of the stud relative to the rail support for relative adjustment of the rail engaging surfaces of the lower pair of toes relative to the rail foot edge;

a rail retaining recess of a prescribed depth into which the rail foot is positioned for lateral restraint; and the upper and lower pairs of toes of the rail clip being so configured and spaced relative to one another that, upon rail upset and consequent deflection of the lower pair of toes toward the upper pair of toes, the upper surface of the lower toes will engage the under surface of the upper toes before ther rail foot exceeds the prescribed depth of the rail retaining recess thereby creating a spring rate change and lockup.

10. The rail fastener of claim 9 wherein the lower limb slot has a length whereby a rear wall thereof is substantially back of the stud stem opposite the rail edge and wherein the point of engagement of the upper and lower toes is substantially along the center line of the stud head.

11. The rail fastener of claim 10 wherein the heel of the rail clip is substantially flat and joins the lower limb through an arcuate portion of relatively small radius compared to the height of the heel such that the bending moment of the lower limb into the rail clip will be greater in the arcuate portion providing increased rail engaging pressure.

12. The rail fastener of claim 11 wherein the stud stem is noncircular and the spacing between the opposed side walls of at least one of the pairs of toes is such that the side walls engage the stem upon the presence of any transverse or rotational force to prevent transverse and rotational movement of the rail clip relative to the stud.

13. The rail fastener of claim 12 wherein the upper limb slot includes a rear wall and the slot is of a length whereby the rear wall is contguous to the stud stem when the stud head engaging surfaces of the upper toes are in position with the reaction surface of the stud to prevent overdrive and overstresing of the rail clip.

14. The rail fastener of claim 13 wherein the rear wall of the upper limb slot is of a configuration complementary to the stud stem configuration.

15. The rail fastener of claim 10 wherein the upper limb slot includes a rear wall and the slot is of a length whereby the rear wall is contiguous to the stud stem when the stud head engaging surfaces of the upper toes are in position with the reaction surface of the stud to prevent overdrive and overstressing of the rail clip.

16. The rail fastener of claim 15 wherein the rear wall of the upper limb slot is of a configuration complementary to the stud stem configuration.

17. A rail retaining clip adapted to be used in combination with a retaining stud welded to as metallic rail support for securing a railroad rail in place comprising:

a generally U-shaped rail clip having a substantially flat heel portion joined through arcuate portions into upper and lower limb portions, the upper limb portion overlying the lower limb portion;

a lower limb slot formed in the lower limb bifurcating the lower limb into a pair of lower toes having opposed side walls, the extremities of the toes being rail engaging surfaces which engage the rail when the clip is in place;

an upper limb slot formed into the upper limb bifurcating the upper limb into a pair of upper toes having opposed side walls and having arcuate depressions adapted to engage the retaining stud when the clip is in place; and upward deflections formed in the lower toes and in vertical alignment with the arcuate depressions of the upper toes and spaced therefrom such that, upon shifting of the lower toes toward the upper toes, eventually the upward deflections of the lower toes will engage the arcuate depressions of the upper toes to create a spring rate change.

18. A rail fastener combination for fastening a rail to a rail support comprising:

a T-shaped retaining stud having a stem portion secured at one end ot the rail support adjacent the rail foot edge and an integral elongated stud head formed upon the other end with its long axis parallel to the rail axis and the under surface of which forms an arcuate reaction surface;

generally U-shaped rail clip having a substantially flat heel portion joined through arcuate portions into upper and lower limb portions, the upper limb portion overlying the lower limb portion;

a lower limb slot formed in the lower limb bifurcating the lower limb into a pair of lower toes having opposed side walls, the extremities of the toes being rail engaging surfaces which engage the rail foot when the clip is in place;

an upper limb slot formed in the upper limb bifurcating the upper limb into a pair of upper toes having opposed side walls and having arcuate depressions mating with the arcuate reaction surface of the stud head to provide an interlock between the stud and rail clip against transverse and rotational movement; and upward deflections in the lower toes in vertical alignment with the arcuate depressions of the upper toes and spaced therefrom a distance such that, upon raising of the lower toes upwardly toward the upper toes, the upper and lower toes will eventually engage one another substantially at the center line of the stud head to provide an increased spring rate whereby installation of the clip upon the stud through the limb slots will provide rail retaining pressure by the rail engaging surfaces upon the rail foot and guard against upset of the rail.

19. The rail fastener of claim 18 wherein the stud stem is rectangular, the spacing of the side walls of the upper and lower toes is slightly larger than the thickness of the stud stem parallel to the rail axis and wherein the upper limb slot includes a flat rear wall and the slot is of length such that the flat rear wall engages the stud stem when the sarcuate depressions of the upper toes are in mating engagement with the arcuate reaction surface of the stud head to prevent overdrive and overdrive and overstressing of the rail clip.

20. A rail fastener for fastening a rail to a rail support, comprising:

a generally U-shaped resilient fastener clip having a heel, an upper limb and a lower limb extending from the heel, a slot in the lower limb bifurcating the lower limb into two toes having rail engaging surfaces at their ends, the width of the upper limb being less than the width of the heel so that the upper limb is a projecting tongue, said tongue having a cam surface at its end which merges into depression surfaces, and a retaining stud secured to and upstanding from the rail support and adjacent an edge of the rail and having an upper edge wall, two side edge walls and a lower edge wall defining an aperture therethrough, said upper edge wall being a downwardly facing reaction surface of the stud which engages the tongue depression surfaces and wherein the toes of the clip are contiuguous with the side edge walls of the stud thereby constraining the clip aganist rotational movement around the stud and against translational movement in the longitudinal direction of the rail while engagement of the tongue with the reaction surface of the stud strains the clip so that consequential stress in the clip causes the rail engaging surfaces of the toes to bear downwardly on the rail and the heel to bear donwardly on the rail support.

* * * * *

UNITED STATES PATENT AND TRADEMARK OFFICE

CERTIFICATE OF CORRECTION

PATENT NO. : 4,778,106

DATED : Oct. 18, 1988

INVENTOR(S) : Diener, et al

It is certified that error appears in the above-identified patent and that said Letters Patent is hereby corrected as shown below:

Column 1 line 7 "applicai-" should read ---applica- ---.

Column 1 line 8 "ton" should read ---tion---.

Column 2 line 49 following "become" there should be inserted ---disengaged from the retaining recess in the rail plate prior to---.

Column 4 line 1 "lib" should read ---limb---.

Column 4 line 22 "cup" should read ---clip---.

Column 5 line 14 following "ally" there should be inserted ---rectangular---.

Column 5 line 31 following "Fig. 1" there should be inserted a ---,---.

Column 5 line 55 "embodiment, embodiment," should read ---embodiment,---.

Column 7 line 14 "matin" should read ---mating---.

Column 7 line 31 "cup" should read ---clip---.

Column 8 line 46 "th" should read ---the---.

UNITED STATES PATENT AND TRADEMARK OFFICE

CERTIFICATE OF CORRECTION

PATENT NO. : 4,778,106

DATED : Oct. 18, 1988

INVENTOR(S) : Diener, et al

It is certified that error appears in the above-identified patent and that said Letters Patent is hereby corrected as shown below:

Column 10 line 21 "cli" should read ---clip---.

Column 11 line 31 "sahped" should read ---shaped---.

Column 11 line 43 "surfaes" should read ---surfaces---.

Column 11 line 44 "heada" should read ---head---.

Column 11 line 54 "cosequent" should read ---consequent---.

Column 11 line 63 "tialy" should read ---tially---.

Column 12 line 43 "libm" should read ---limb---.

Column 12 line 46 "palce" should read ---place---.

Column 12 line 52 "uppon" should read ---upon---.

Column 13 line 27 "contguous" should read ---contiguous---.

Column 13 line 43 "as" should read ---a---.

Column 12, line 42, "bifurctaing" should read --bifurcating--.

UNITED STATES PATENT AND TRADEMARK OFFICE

CERTIFICATE OF CORRECTION

PATENT NO. : 4,778,106

DATED : Oct. 18, 1988

INVENTOR(S) : Diener, et al

It is certified that error appears in the above-identified patent and that said Letters Patent is hereby corrected as shown below:

Column 13 line 68 "ot" should read ---to---.

Column 14 line 5 before "generally" ---a--- should be inserted.

Column 14 line 37 "sarcuate" should read ---arcuate---.

Column 14 line 39 "overdrive and overdrive" should read ---overdrive---.

Column 14 line 58 "contiuguous" should read ---contiguous---.

Column 14 line 66 "don-" should read ---down- ---.

Signed and Sealed this

Twenty-first Day of August, 1990

*Attest:*

*Attesting Officer*

HARRY F. MANBECK, JR.

*Commissioner of Patents and Trademarks*